US010233527B2

(12) United States Patent
Kim et al.

(10) Patent No.: US 10,233,527 B2
(45) Date of Patent: Mar. 19, 2019

(54) COOLING APPARATUS FOR PLATED STEEL SHEET

(71) Applicant: POSCO, Pohang-si, Gyeongsangbuk-do (KR)

(72) Inventors: Jung-Kuk Kim, Gwangyang-si (KR); Yeon-Chae Jeung, Gwangyang-si (KR)

(73) Assignee: POSCO, Pohang-si, Gyeongsangbuk-do (KR)

( * ) Notice: Subject to any disclaimer, the term of this patent is extended or adjusted under 35 U.S.C. 154(b) by 271 days.

(21) Appl. No.: 15/113,728

(22) PCT Filed: Dec. 3, 2014

(86) PCT No.: PCT/KR2014/011760
§ 371 (c)(1),
(2) Date: Jul. 22, 2016

(87) PCT Pub. No.: WO2015/111837
PCT Pub. Date: Jul. 30, 2015

(65) Prior Publication Data

US 2017/0002451 A1 Jan. 5, 2017

(30) Foreign Application Priority Data

Jan. 27, 2014 (KR) ..... 10-2014-0009808

(51) Int. Cl.
*C23C 2/00* (2006.01)
*C23C 2/28* (2006.01)
(Continued)

(52) U.S. Cl.
CPC ..... *C23C 2/28* (2013.01); *C23C 2/003* (2013.01); *C23C 2/04* (2013.01); *C23C 2/40* (2013.01)

(58) Field of Classification Search
CPC ..... C21D 1/667; C21D 9/573
See application file for complete search history.

(56) References Cited

U.S. PATENT DOCUMENTS 6,054,095 A 4/2000 Minato et al.
6,301,906 B1 * 10/2001 Thiel ..... B21B 45/0218 62/374
(Continued)

FOREIGN PATENT DOCUMENTS

EP 2 594 658 A1 5/2013
JP 56-084456 A 7/1981
(Continued)

OTHER PUBLICATIONS

Extended European Search Report dated Dec. 8, 2016 issued in European Patent Application No. 14879669.1.
(Continued)

*Primary Examiner* — Scott R Kastler
(74) *Attorney, Agent, or Firm* — Morgan Lewis & Bockius LLP

(57) ABSTRACT

A cooling apparatus for a plated steel sheet according to the present invention comprises: an injection means for injecting a cooling fluid while facing a steel sheet in progress; and an injection width varying means for varying the injection width of the cooling fluid so as to correspond to the width of the steel sheet, installed at the outside of the injection means so as to not interfere with the injection flow path of the cooling fluid.

10 Claims, 13 Drawing Sheets

(51) Int. Cl.
*C23C 2/40* (2006.01)
*C23C 2/04* (2006.01)

(56) References Cited

U.S. PATENT DOCUMENTS

2015/0101386 A1* 4/2015 Nikaido ..... B21B 45/0218 72/342.2
2017/0002451 A1* 1/2017 Kim ..... C23C 2/28

FOREIGN PATENT DOCUMENTS

JP H07-009969 U 2/1995
JP H08-215733 A 8/1996
JP 8-269664 A 10/1996
JP 2009-108380 A 5/2009
KR 10-2008-0111603 A 12/2008
KR 10-2012-0043567 A 5/2012
KR 10-2013-0034355 A 4/2013
KR 10-2013-0074269 A 7/2013
WO 97/44498 A1 11/1997

OTHER PUBLICATIONS

International Search Report dated Feb. 26, 2015 issued in International Patent Application No. PCT/KR2014/011760 (English translation).
Japanese Office Action dated Oct. 3, 2017 issued in Japanese Patent Application No. 2016-548277 (with English translation).
European Office Action issued in corresponding European Patent Application No. 14879669.1, dated May 23, 2018.

* cited by examiner

【Fig. 1】
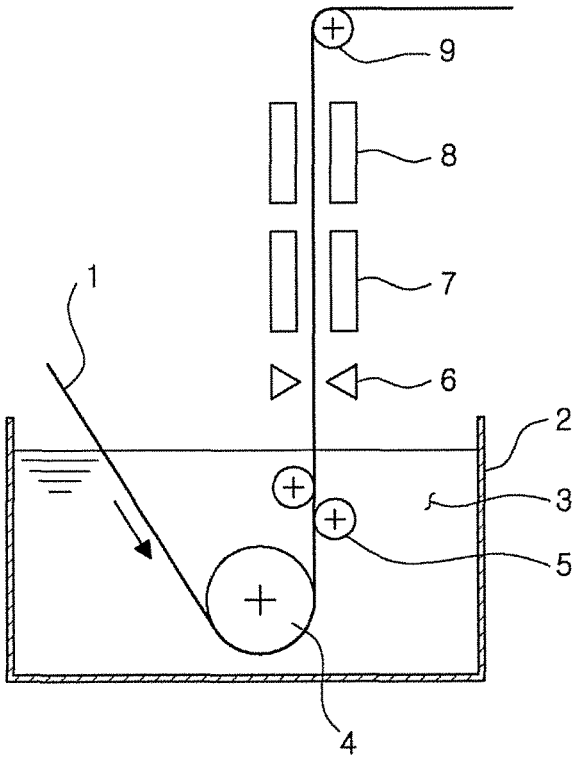
PRIOR ART

【Fig. 2】
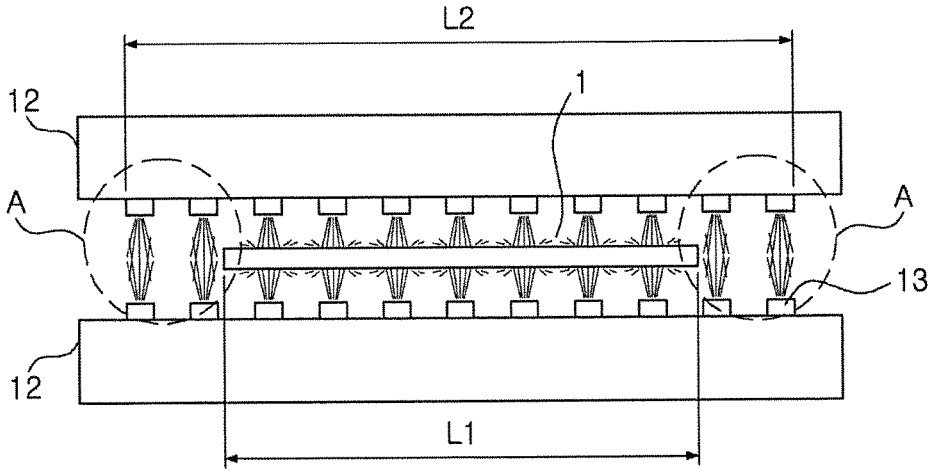
PRIOR ART

【Fig. 3】
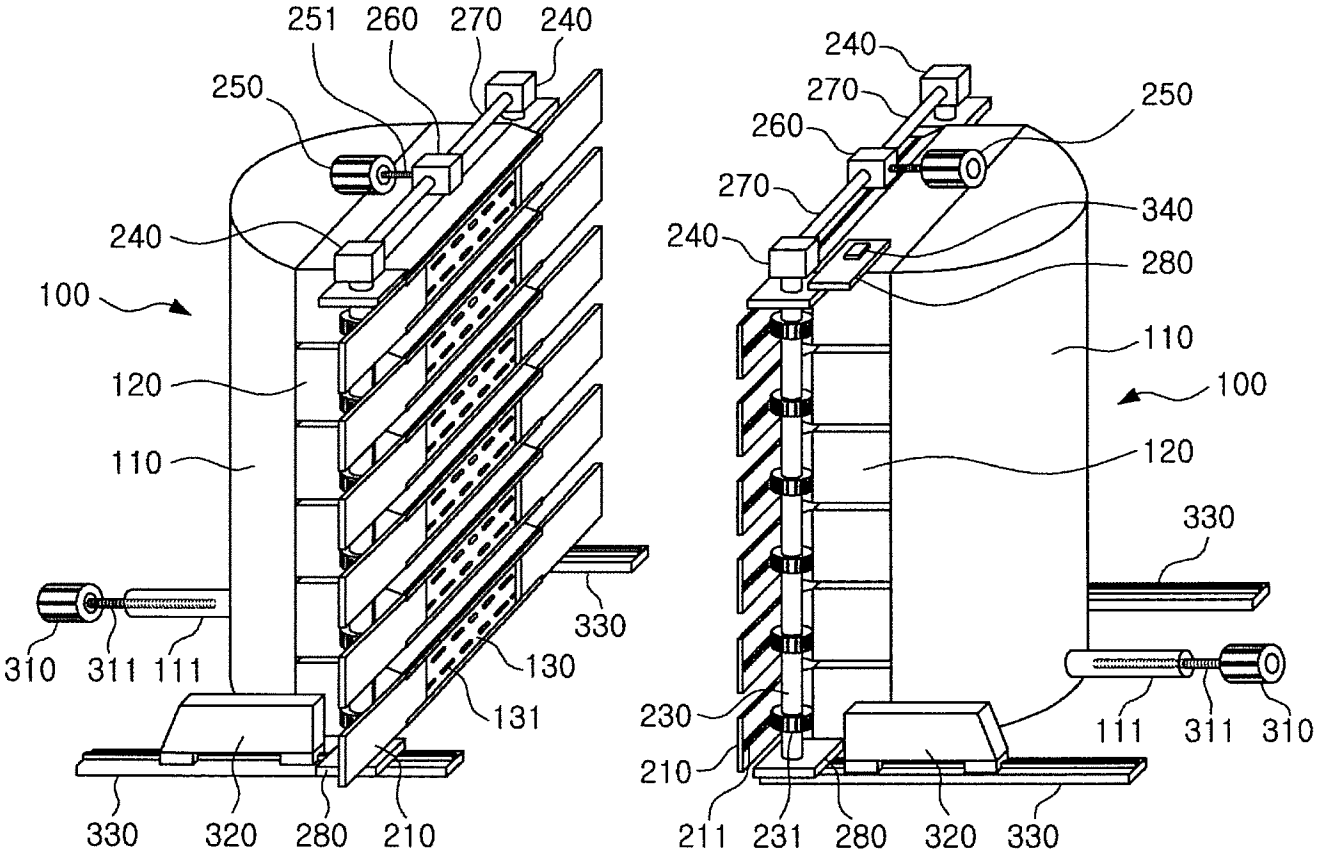

【Fig. 4】
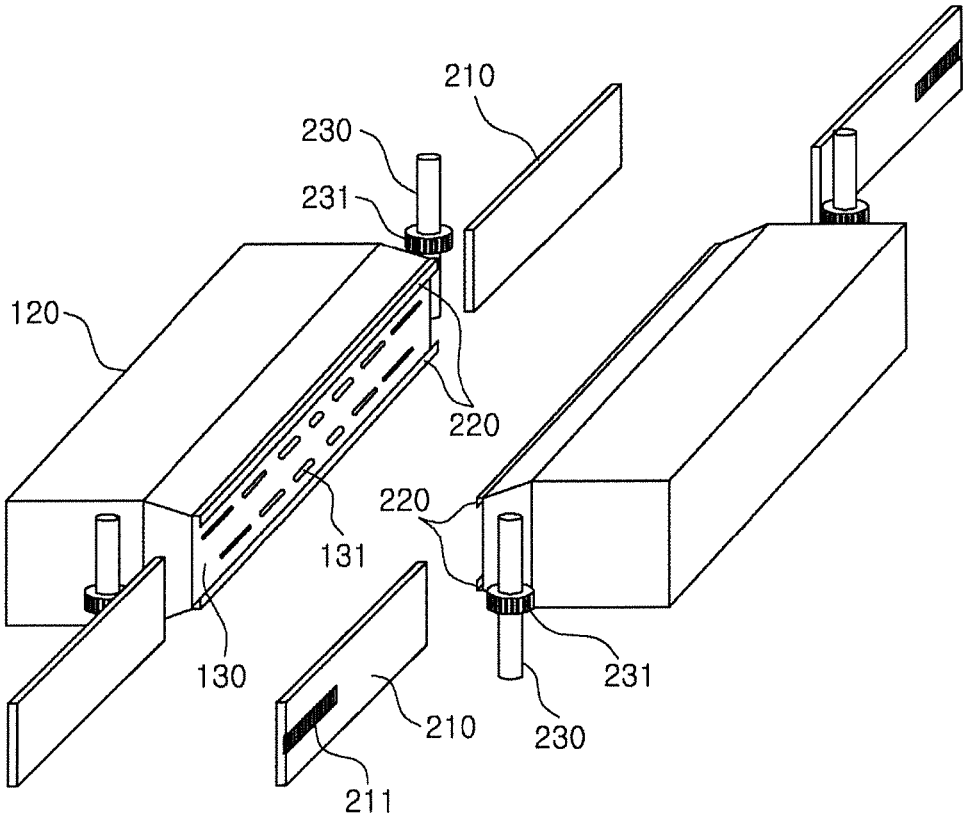

【Fig. 5】
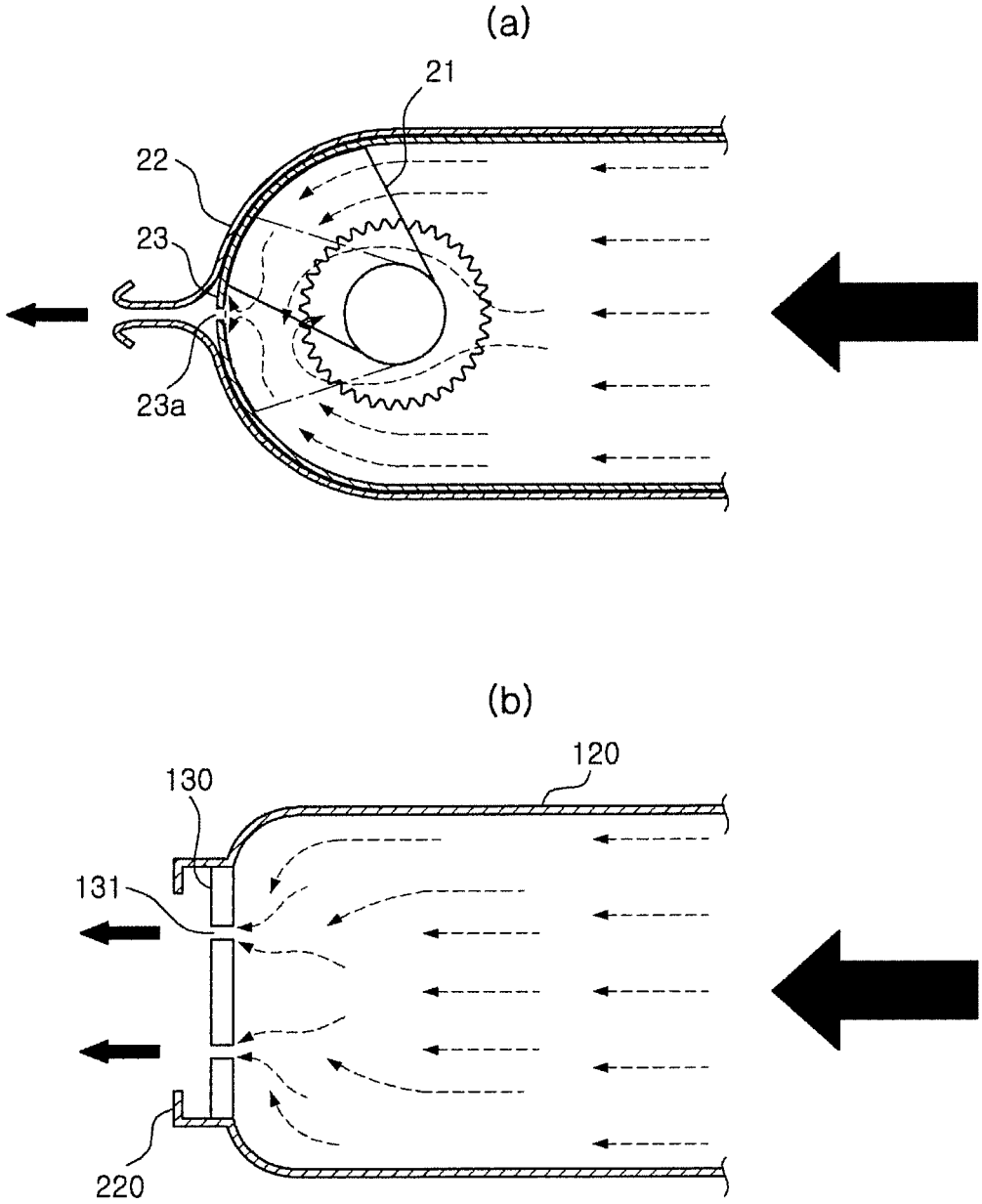

【Fig. 6】
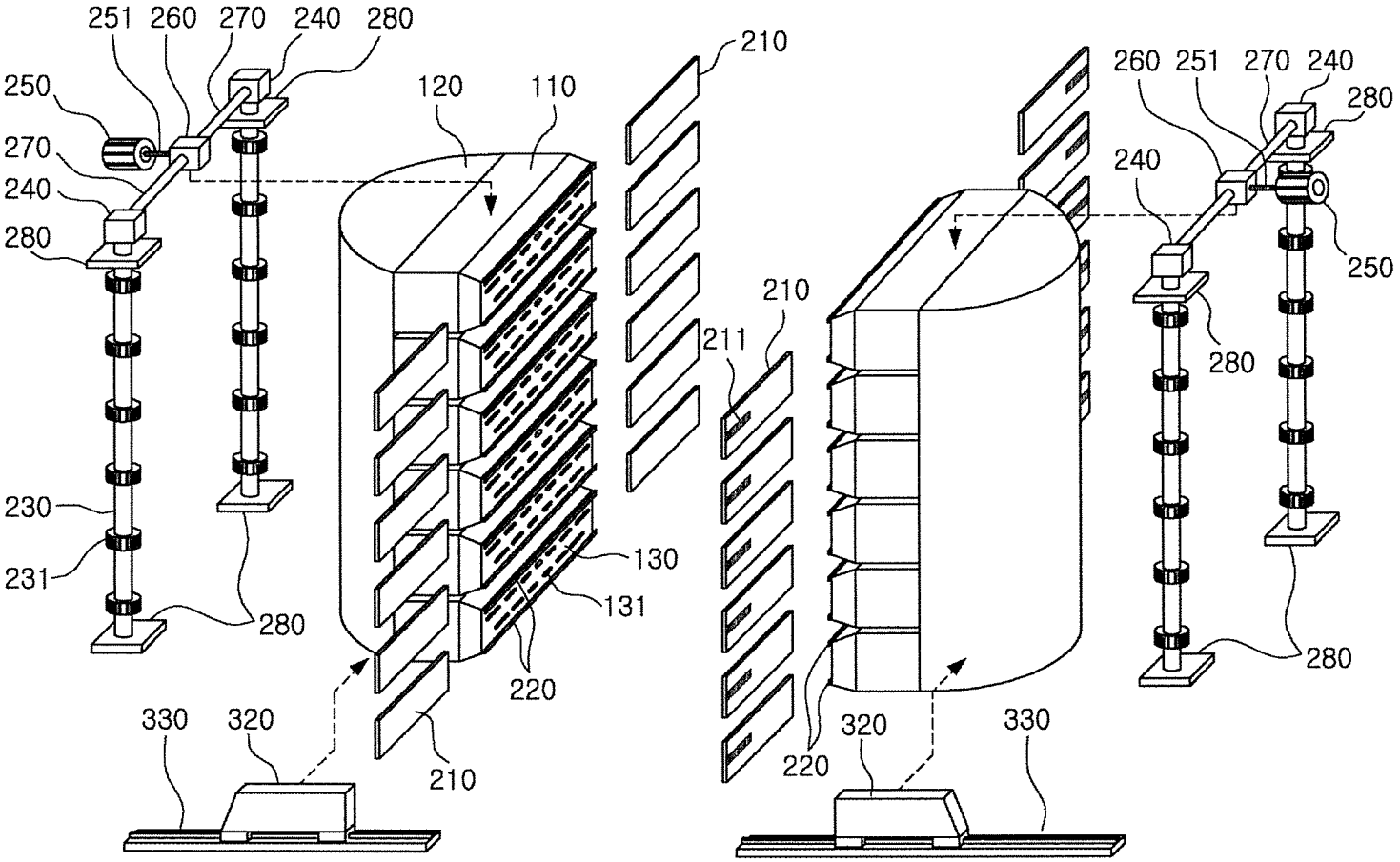

【Fig. 7】
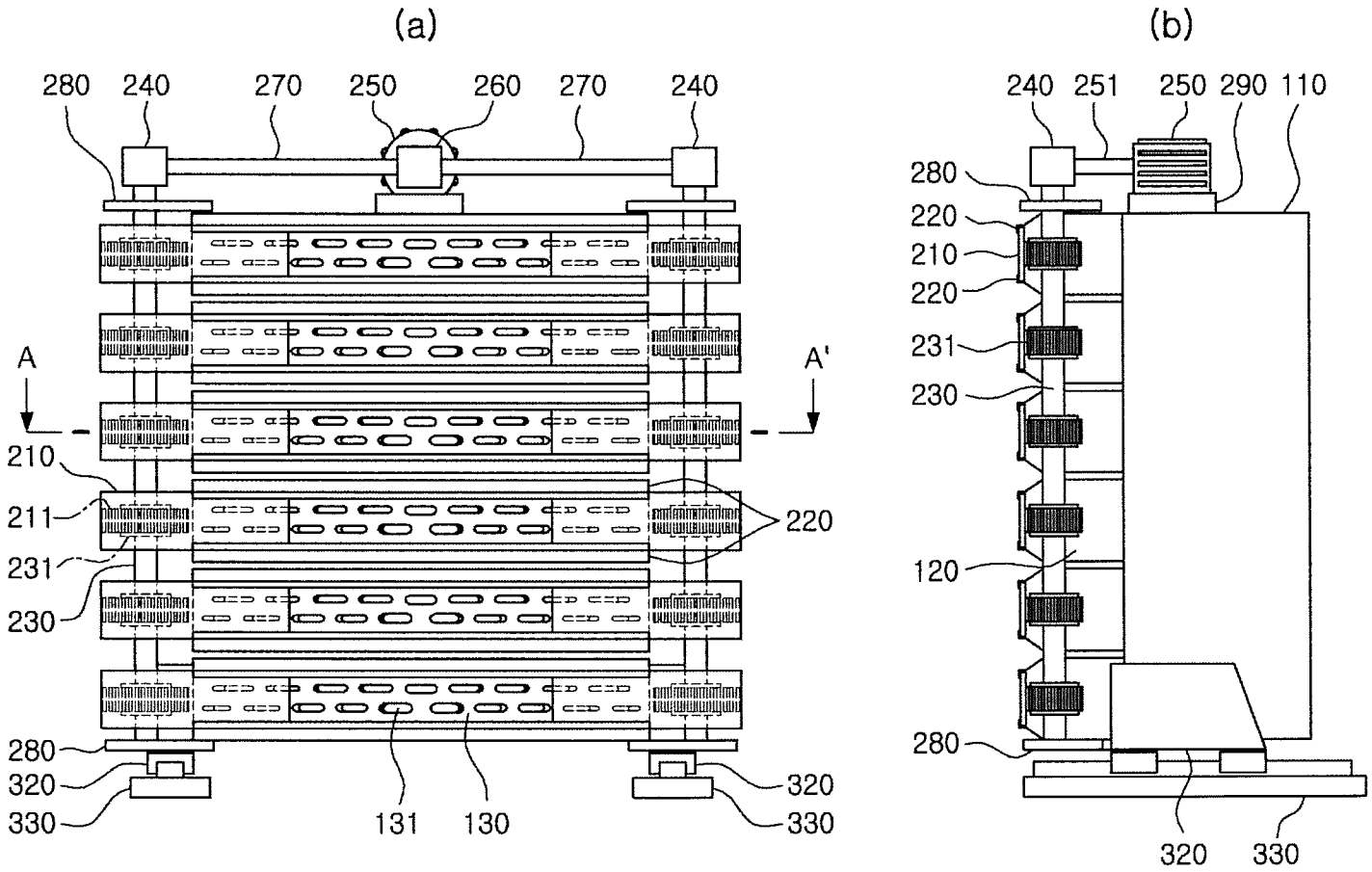

【Fig. 8】
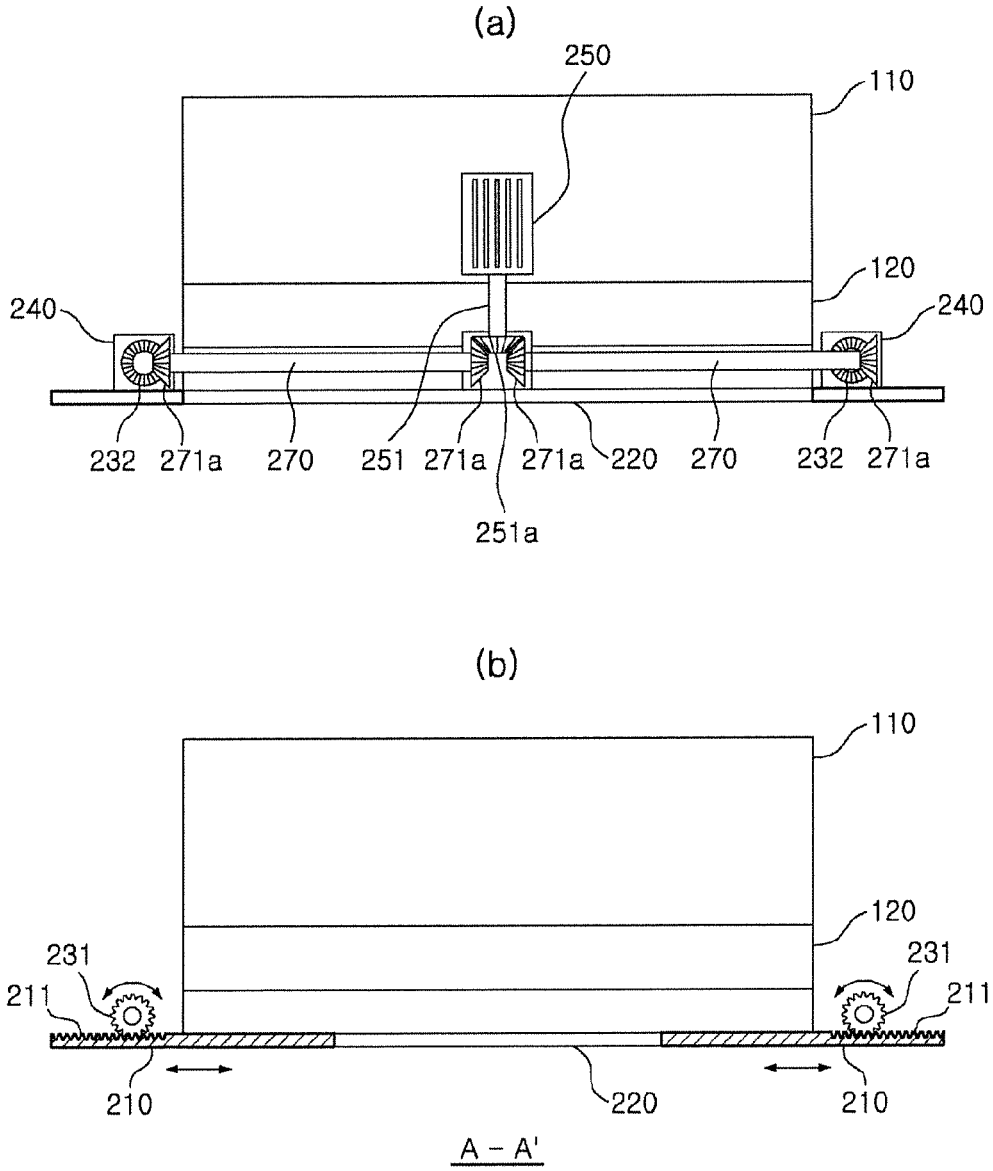

【Fig. 9】
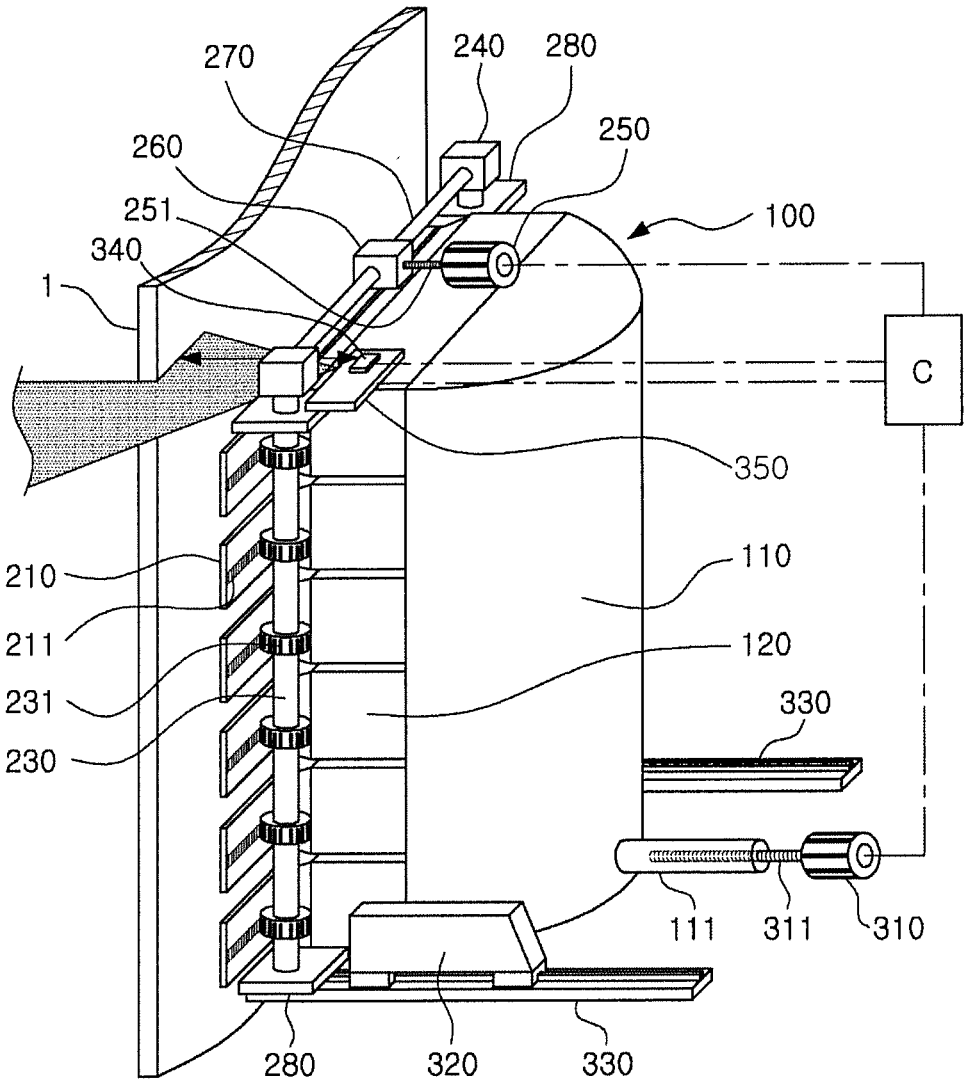

【Fig. 10】
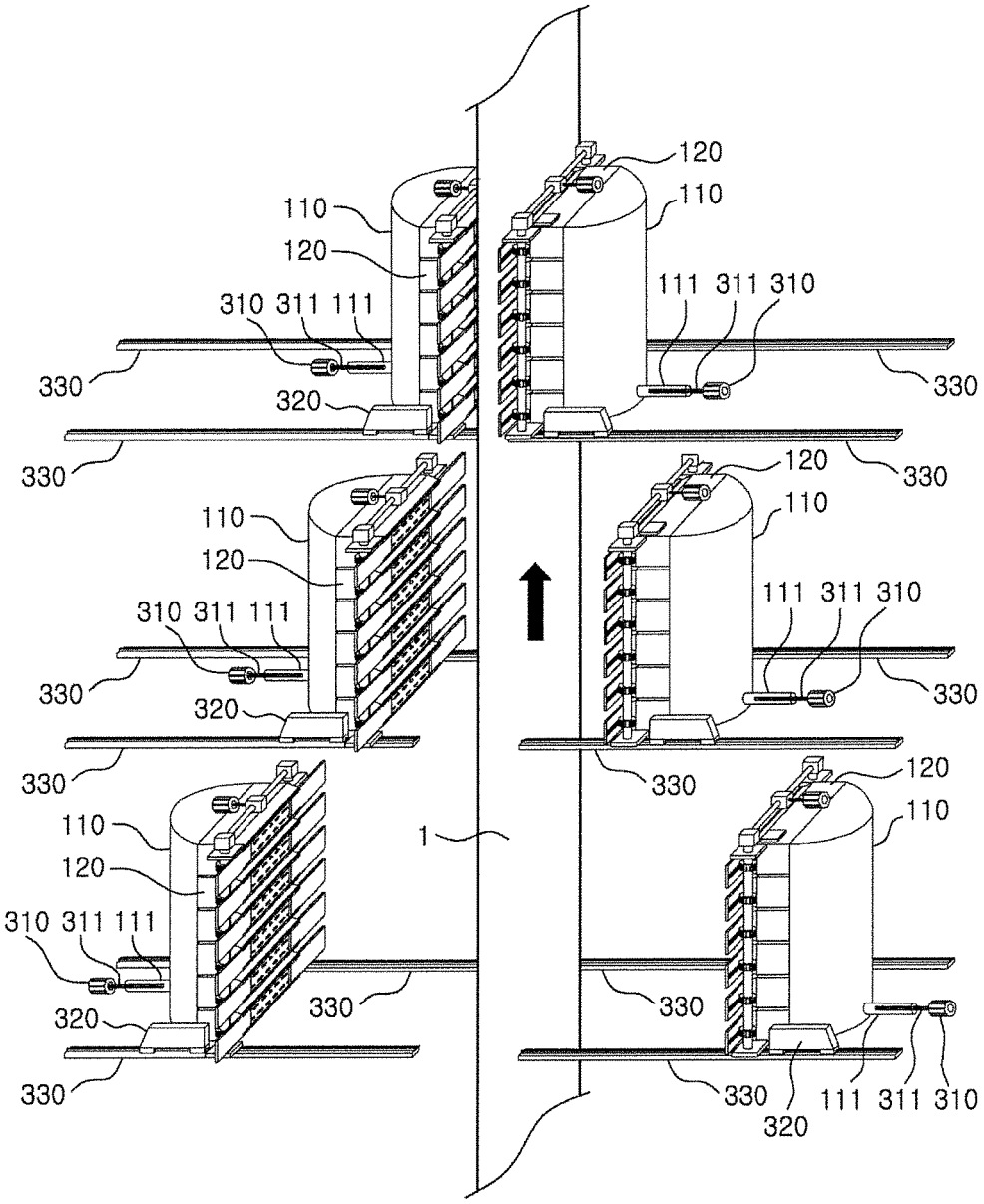

【Fig. 11】
(a)
| | | STEEL SHEET CONDITIONS(mm) | | BLOWER OPERATION RATE(%) | SPRAYING WIDTH (mm) | SPRAYING DISTANCE (mm) |
|---|---|---|---|---|---|---|
| | | THICKNESS | WIDTH | | | |
| FIXED CONDITIONS | PRESENT | 0.554 | 1232.8 | 80 | 2200 | 100 |
| VARIED CONDITIONS | P1 | 0.576 | 1223.1 | 80 | 1223 | 100 |
| | P2 | 0.576 | 1223.1 | 80 | 1323 | 100 |
| | P3 | 0.576 | 1223.1 | 80 | 1423 | 100 |
| | P4 | 0.576 | 1223.1 | 80 | 2200 | 70 |
| | P5 | 0.576 | 1223.1 | 80 | 2200 | 100 |
| | P6 | 0.576 | 1223.1 | 80 | 2200 | 130 |
| | P7 | 0.576 | 1223.1 | 80 | 2200 | 150 |
(b)
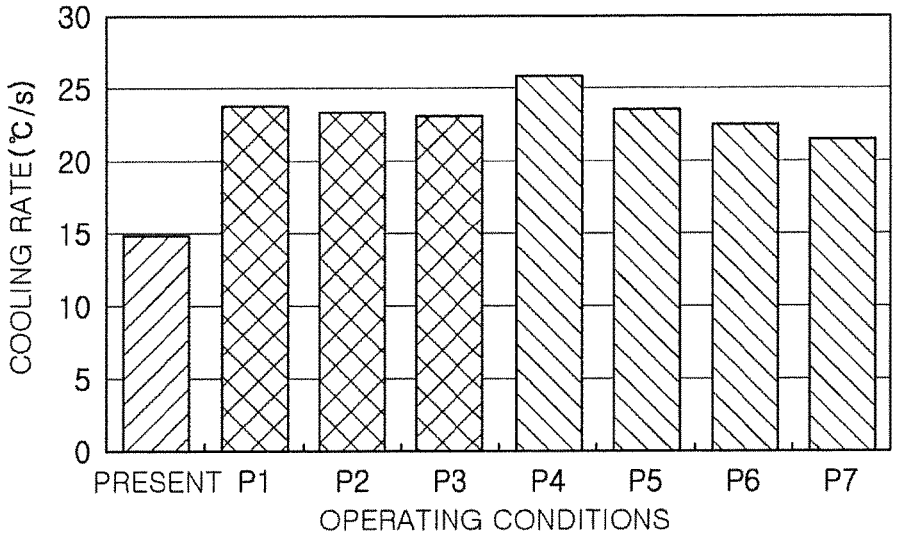

【Fig. 12】
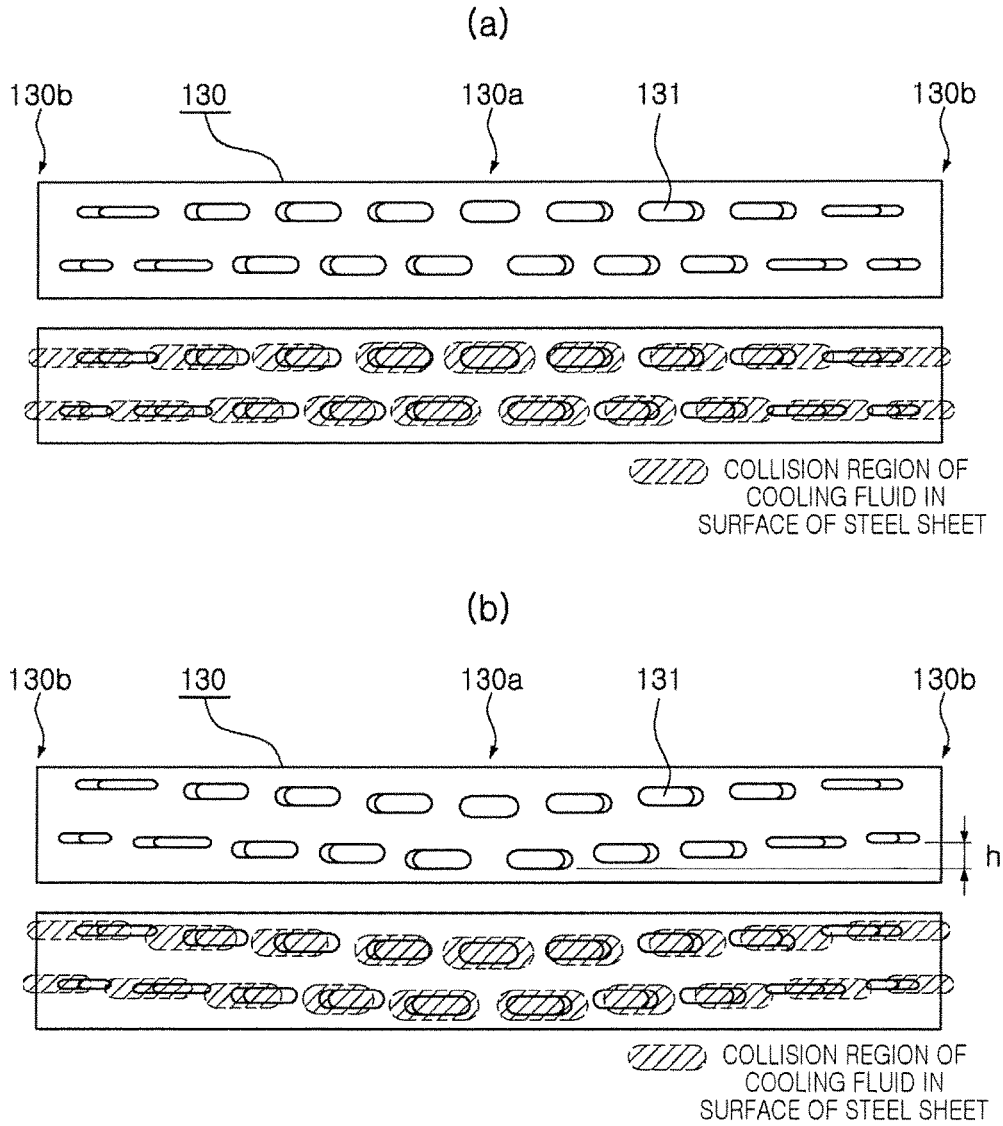

【Fig. 13】
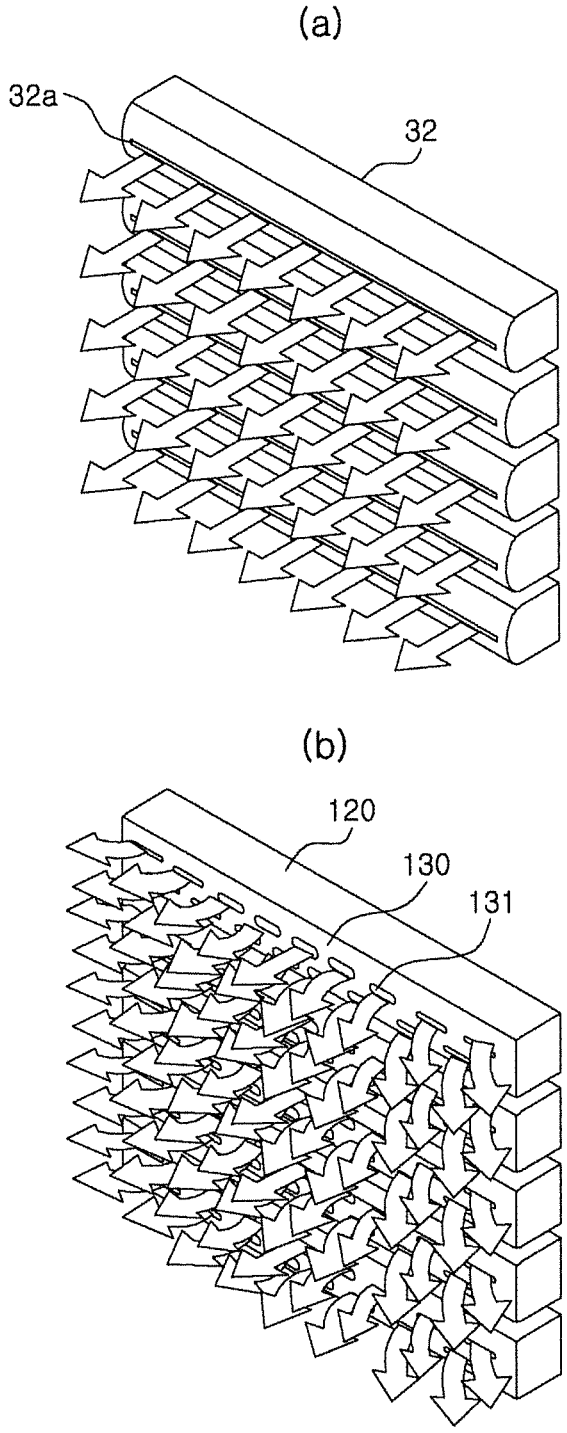

COOLING APPARATUS FOR PLATED STEEL SHEET

RELATED APPLICATIONS

This application is the U.S. National Phase under 35 U.S.C. § 371 of International Application No. PCT/KR2014/011760, filed on Dec. 3, 2014, which in turn claims the benefit of Korean Patent Application No. 10-2014-0009808, filed on Jan. 27, 2014, the disclosure of which applications are incorporated by reference herein.

TECHNICAL FIELD

The present disclosure relates to a plated steel sheet cooling apparatus and, more particularly, to a plated steel sheet cooling apparatus for increasing cooling efficiency of a steel sheet and reducing vibrations thereof.

BACKGROUND ART

In recent years, demand for a plated steel sheet having improved corrosion resistance or the like, improved appearance, and specially used as a steel sheet for electronic products and vehicles, has increased. For example, an alloy-plated steel sheet has excellent spot weldability, corrosion resistance after coating, and coating adhesion. Thus, demand for such a steel sheet for use in building materials, home appliances, and vehicles has recently increased.

FIG. 1 is a schematic view illustrating a general plating line for a steel sheet, and FIG. 2 is a plan view illustrating a cooling fluid being sprayed onto a plated steel sheet by a plated steel sheet cooling apparatus according to the related art.

With reference to FIG. 1, after a steel sheet 1 (a cold-rolled steel sheet) unwound from a pay-off-reel passes through a welder and a looper and heat-treated molten metal, for example, molten zinc 3, is attached to a surface of the steel sheet 1 while the steel sheet passes through a snout, below a sink roll 4 and through stabilizing rolls 5 of a plating bath 2. In addition, a high pressure gas (inert gas or air) is sprayed from a gas wiping device 6 (commonly referred to as an 'air knife') above a plating bath to control a plating thickness of the steel sheet 1.

In addition, the plated steel sheet 1 is plated while passing through a vibration damping facility 7, a cooling facility 8, and transferring rolls 9. The vibration damping facility suppresses vibrations of the steel sheet 1 passing through a gas wiping region to uniformly control a plating thickness.

Here, the cooling facility 8 is provided on both sides of the steel sheet 1 being vertically transferred according to the related art, and thus, the cooling facility may be referred to as a cooling tower.

Such a cooling facility 8 of the plated steel sheet is an important facility in solidifying a zinc-plated layer in a liquid phase attached to a surface of a high-temperature plated steel sheet being vertically transferred, and quickly cooling a temperature of the steel sheet 1 to be 300° C. or less immediately before the transferring roll 9 to smoothly perform transferring or a post process of the steel sheet 1 thereafter.

In this case, as illustrated in FIG. 2, a cooling facility according to the related art may include spraying nozzles 13 provided in a predetermined pattern in nozzle chambers 12 opposing each other on both sides of a steel sheet 1.

However, an arrangement width of the spraying nozzles 13 is fixed to be relatively greater than a maximum width L1 of the steel sheet 1 to be plated and produced. Thus, in a case in which the width L1 of the steel sheet 1 to be plated is narrower than a width L2 of a region in which cooling fluids are sprayed through the spraying nozzles, in regions 'A' in which the steel sheet 1 is not present, the cooling fluids sprayed at a high pressure collide with each other, thereby amplifying a vortex.

Such vortex amplification allows vibrations of an edge portion to be amplified in both edges of the steel sheet 1 while being vertically transferred.

Such an increase in the vibrations of the steel sheet 1 may cause various problems in a plating line. As tension applied to the stabilizing rolls 5 or the transferring rolls 9 for a reduction in the vibration of the steel sheet is increased, abrasion of the rolls may be increased and a cooling performance may also be reduced. In addition, as it may be difficult to increase a plating rate of the steel sheet 1 due to the vibrations of the steel sheet, productivity may be reduced.

In addition, as illustrated in FIG. 2, in a case in which a narrow plated steel sheet is produced, an excessive amount of cooling fluids is sprayed even to areas in which the steel sheet 1 is not present in a width direction. Thus, an air blower may be overloaded and a cooling efficiency thereof may be reduced, which may be various causes of a reduction in productivity.

DISCLOSURE

Technical Problem

An aspect of the present disclosure may provide a plated steel sheet cooling apparatus increasing a cooling efficiency of a steel sheet and reducing vibrations thereof by varying a width of an area in which a cooling fluid is sprayed according to a width of a steel sheet, and adjusting a distance between a steel sheet and a spraying unit in consideration of a defect generation distance of a plating layer according to a solidified state of the plating layer to solve the problem described above.

Technical Solution

According to an aspect of the present disclosure, a plated steel sheet cooling apparatus may include: a spraying unit opposing a driving steel sheet and spraying a cooling fluid; and a spraying width varying unit varying a spraying width of the cooling fluid to correspond to a width of the steel sheet, and installed outside of the spraying unit so as not to interfere with a spraying flow path of the cooling fluid.

According to another aspect of the present disclosure, a plated steel sheet cooling apparatus may include: a spraying unit opposing a driving steel sheet and spraying a cooling fluid; and a spraying distance adjusting unit provided in the spraying unit to adjust a distance between the steel sheet and the spraying unit.

The spraying width varying unit may include: a nozzle shield plate installed in a front of the spraying unit, and varying the spraying width of the cooling fluid while being moved far from and near to each other on both sides; and a plate driving unit moving two of the nozzle shield plates.

The nozzle shield plate may have a rack gear, and the plate driving unit may include a rotary shaft having a pinion gear engaged with the rack gear; and a rotary driving member rotating the rotary shaft.

When two of the respective rotary shafts connected to two of the respective nozzle shield plates, respectively are disposed on both sides of the spraying unit, respectively, the rotary driving member may include: lateral gearboxes mounted on upper ends of the respective rotary shafts and disposed to be two lateral gearboxes thereon; a rotary driving motor installed on the spraying unit; a central gearbox to which a motor shaft of the rotary driving motor is connected; and two connection bars in which one end is connected to the lateral gearbox and the other end is connected to the central gearbox.

When a nozzle chamber having spraying nozzles is stacked to be a plurality of nozzle chambers in the spraying unit, the nozzle shield plate is disposed to be a plurality of nozzle shield plates to correspond to the plurality of nozzle chambers.

The spraying width varying unit may further include: plate guides holding and supporting the nozzle shield plate, and slide-guiding the nozzle shield plate when the nozzle shield plate is moved, in respective upper and lower portions of the front of the spraying unit.

The spraying width varying unit may further include: a width sensor installed in the spraying unit to measure a width of the steel sheet; and a control unit electrically linked to the width sensor and the plate driving unit, and controlling movement of the nozzle shield plates according to the width of the steel sheet.

The spraying distance adjusting unit may include: a fixed frame; and a forward and backward driving motor whose position is fixed, relative to the fixed frame, and including a motor shaft screw-fastened to the spraying unit to move the spraying unit far from and near to the steel sheet in rotation.

The spraying distance adjusting unit may further include: a slider fixed to and mounted on the spraying unit; and a guide rail whose position is fixed, relative to the fixed frame and to which the slider is fastened to be slide-moved.

The spraying distance adjusting unit may further include a distance sensor installed in the spraying unit to measure a distance from the steel sheet; and a control unit electrically linked to the distance sensor and the forward and backward driving motor, and controlling movement of the spraying unit to correspond to a distance from the steel sheet which is to be set.

The spraying units may be disposed to have a multilayer structure in a direction of driving of the steel sheet, and as a plating solution in the steel sheet is solidified, the spraying units are disposed to be close to the steel sheet by the spraying distance adjusting unit.

Advantageous Effects

According to a plated steel sheet cooling apparatus of an exemplary embodiment in the present disclosure, a spraying width varying unit of an exemplary embodiment in the present disclosure varies a spraying width of a cooling fluid to correspond to a width of a steel sheet to improve a cooling performance and to reduce vibrations of the steel sheet. Furthermore, the spraying width varying unit is installed outside of a spraying unit so as not to interfere with a cooling fluid flow path inside of the spraying unit, and thus collisions of flows of a cooling fluid are prevented inside the spraying unit. Thus, fluid flow resistance is significantly reduced, and a reduction in a spraying pressure of the cooling fluid is prevented, thereby further increasing a cooling performance.

In addition, a spraying distance adjusting unit of an exemplary embodiment in the present disclosure adjusts a distance between the steel sheet and the spraying unit in consideration of a defect generation distance of a plating layer according to a solidified state of the plating layer to increase a cooling performance.

DESCRIPTION OF DRAWINGS

FIG. 1 is a schematic view illustrating a general plating line of a steel sheet.

FIG. 2 is a plan view illustrating a cooling fluid sprayed by a plated steel sheet cooling apparatus according to the related art to a steel sheet.

FIG. 3 is a perspective view illustrating a plated steel sheet cooling apparatus according to an exemplary embodiment in the present disclosure.

FIG. 4 is an exploded perspective view illustrating a spraying width varying unit in the plated steel sheet cooling apparatus in FIG. 3.

FIG. 5A is a side view of an inside of a plated steel sheet cooling apparatus according to the related art in which a spraying width varying unit is embedded in a nozzle chamber, and FIG. 5B is a side view of an inside of a nozzle chamber in the plated steel sheet cooling apparatus in FIG. 3.

FIG. 6 is an exploded perspective view illustrating the plated steel sheet cooling apparatus in FIG. 3.

FIGS. 7A and 7B are a front view and a side view illustrating the plated steel sheet cooling apparatus in FIG. 3.

FIG. 8A is a plan view illustrating the plated steel sheet cooling apparatus in FIG. 7A, and FIG. 8B is a cross-sectional view taken along line A-A' of FIG. 7A.

FIG. 9 is a view illustrating that a width sensor and a distance sensor detect a width and a distance of a steel sheet in the plated steel sheet cooling apparatus in FIG. 3.

FIG. 10 is a view illustrating that a spraying unit disposed to have a multilayer structure is disposed to be close to a steel sheet by a spraying distance adjusting unit as a plating solution in the steel sheet is solidified.

FIG. 11A is a table illustrating material conditions of a steel sheet and operating conditions of a spraying width and a spraying distance of a plated steel sheet cooling apparatus, and FIG. 11B is a graph illustrating a cooling performance according to the table in FIG. 11A.

FIGS. 12A and 12B are views illustrating exemplary embodiments with respect to an arrangement structure of a spraying nozzle provided in a nozzle spraying plate in the plated steel sheet cooling apparatus in FIG. 3.

FIG. 13A is a view illustrating a path in which a cooling fluid is sprayed through a non-inclined spraying nozzle in a plated steel sheet cooling apparatus according to the related art, and FIG. 13B is a view illustrating a path in which a cooling fluid is sprayed through an inclined spraying nozzle in the plated steel sheet cooling apparatus in FIG. 3.

BEST MODE FOR INVENTION

FIG. 3 is a perspective view illustrating a plated steel sheet cooling apparatus according to an exemplary embodiment in the present disclosure, and FIG. 4 is an exploded perspective view illustrating a spraying width varying unit in the apparatus for cooling a plated steel sheet in FIG. 3.

With reference to FIGS. 3 and 4, a plated steel sheet cooling apparatus according to an exemplary embodiment in the present disclosure may include a spraying unit spraying a cooling fluid onto a steel sheet 1, a spraying width varying unit and a spraying distance adjusting unit installed in the spraying unit. Here, a spraying width means a width of an entire area which is sprayed by a spraying unit.

Here, the spraying units are disposed on one side and the other side of the steel sheet 1, respectively and formed to spray a cooling fluid onto the steel sheet while opposing the driving steel sheet 1.

Such a spraying unit may include a main body 100 and spraying nozzles formed in the main body 100. In detail, the main body 100 may include a main chamber 110, and nozzle chambers 120. A nozzle spraying plate 130 in which the spraying nozzles are formed, may be mounted on the nozzle chamber 120.

In this case, the main chamber 110 may be connected to a fluid supply line (not shown) receiving a cooling fluid, and the nozzle chamber 120 may be provided with a plurality of nozzle chambers 120 to have a multilayer structure in a direction of driving of the steel sheet 1 on the main chamber 110.

In addition, the spraying width varying unit may be installed in the spraying unit to vary a spraying width of a cooling fluid to correspond to a width of the steel sheet 1.

In this case, as main technical features of an exemplary embodiment of the present disclosure, the spraying width varying unit is installed outside of the spraying unit to prevent collisions of a cooling fluid flow inside the spraying unit in a manner different from the related art.

In detail, with reference to such a spraying width varying unit, the spraying width varying unit may include nozzle shield plates 210 installed on a front of the spraying unit, and a plate driving unit allowing the nozzle shield plates 210 to be moved.

Here, the nozzle shield plate 210 is installed on a portion discharging a cooling fluid in the nozzle chamber 120, as a front of the spraying unit. To shield a desired and predetermined portion of a plurality of spraying nozzles in the nozzle spraying plate 130 disposed on a discharge unit of the nozzle chamber 120, the two nozzle shield plates 210 are moved far from and near to each other to vary a spraying width of a cooling fluid. In other words, the two nozzle shield plates 210 are disposed on one side and the other side of the discharge unit of the nozzle chamber 120, respectively. A space between the two nozzle shield plates not shielding the spraying nozzle is to be a spraying width of a cooling fluid. As the two nozzle shield plates move closer towards or further apart from each other, a spraying width of a cooling fluid may be varied.

The nozzle shield plates 210 may be held and supported by plate guides 220 formed on upper and lower portions of the front of the spraying unit, and may be slide-guided by the plate guides 220 when the nozzle shield plates are moved.

In addition, the plate driving unit serves to move the two nozzle shield plates 210. In detail, the plate driving unit may include a rotary shaft 230 connected to the nozzle shield plate 210, and a rotary driving member allowing the rotary shaft 230 to be rotated.

In this case, a rack gear 211 may be formed in the nozzle shield plate 210, and a pinion gear 231 engaged with the rack gear 211 of the nozzle shield plate 210 may be formed in the rotary shaft 230. The rotary driving member allows the rotary shaft 230 to be rotated, and thus the pinion gear 231 is rotated and the rack gear 211 is moved linearly. Thus, the nozzle shield plate 210 may be moved in the discharge unit of the nozzle chamber 120.

As described above, the spraying width varying unit is installed outside of the spraying unit so as not to interfere with a cooling fluid flow path inside the spraying unit, and thus, collisions of the of cooling fluid flows inside the spraying unit is prevented. Thus, flow resistance of a fluid is significantly reduced, and a spraying pressure of the cooling fluid is prevented from being reduced, thereby increasing a cooling performance.

In other words, as illustrated in FIG. 5A, a plated steel sheet cooling apparatus according to the related art includes a spraying width varying unit embedded in a nozzle chamber 22. Thus, in a process in which a cooling fluid supplied to the nozzle chamber 22 flows to a spraying nozzle 23*a* formed in a nozzle spraying plate 23, as collision of the flows of cooling fluids occurs by an internal rotary shielding member 21 disposed in a flow path, loss of a spraying pressure is increased by a reduction in a flow pressure, and flow resistance due to vortex flow.

On the other hand, as illustrated in FIGS. 4 and 5B, the spraying width varying unit is not disposed inside the nozzle chamber 120 of the spraying unit. In detail, the nozzle shield plate 210 of the spraying width varying unit is disposed in a front of the nozzle spraying plate 130 in which the spraying nozzle is formed, thereby preventing collisions of the of cooling fluid flows and preventing vortex flow inside the spraying unit. Thus, flow resistance of a fluid is significantly reduced, thereby preventing a reduction in a spraying pressure of the cooling fluid.

The spraying width varying unit including the nozzle shield plates 210 installed outside of the nozzle chamber 120 will be described in detail with reference to FIGS. 6 to 8.

FIG. 6 is an exploded perspective view illustrating the plated steel sheet cooling apparatus of FIG. 3, and FIGS. 7A and 7B are a front view and a side view illustrating the plated steel sheet cooling apparatus of FIG. 3. In addition, FIG. 8A is a plan view illustrating the plated steel sheet cooling apparatus of FIG. 7A, and FIG. 8B is a cross-sectional view taken along line A-A' of FIG. 7A.

With reference to FIGS. 6, 7A, 7B, 8A, and 8B, when the two rotary shafts 230 connected to the two nozzle shield plates 210 are disposed on both sides of the spraying unit, respectively, the rotary driving member may include lateral gearboxes 240, a rotary driving motor 250, a central gearbox 260, and connection bars 270.

Here, the lateral gearbox 240 may be mounted on an upper end of each of the rotary shafts 230 and disposed to be two lateral gearboxes 240. The rotary driving motor 250 may be installed in the spraying unit, and by way of example, may be disposed on an upper end of the main body 100.

In addition, the central gearbox 260 has a structure to which a motor shaft 251 of the rotary driving motor 250 is connected. The connection bar 270 in which one end is connected to the lateral gearbox 240 and the other end is connected to the central gearbox 260, may be formed to be two central gearboxes.

Connection bevel gears 271*a* are formed in both ends of the connection bar 270, a rotary bevel gear 232 is formed on an upper end of the rotary shaft 230, and a motor bevel gear 251*a* is formed in an end of the motor shaft 251 of the rotary driving motor 250. Thus, the two rotary shafts 230 disposed on both sides of the spraying unit, respectively, may be linked and rotated by the one rotary driving motor 250.

Supports 280 may be mounted on upper and lower portions of the rotary shaft 230 to have a solid support structure while the supports are connected to the nozzle chambers 120. In addition, a stand 290 may be mounted on an upper portion of the main chamber 110 to stably hold and support the rotary driving motor 250.

When the nozzle chamber 120 including the spraying nozzles is stacked to be a plurality of nozzle chambers in the spraying unit, the nozzle shield plate 210 may be disposed to be a plurality of nozzle shield plates to correspond to the plurality of the nozzle chambers 120. In this case, the rotary shaft 230 is extended to a level in which the nozzle chambers 120 are stacked, and the pinion gear 231 is formed on the rotary shaft 230 to be a plurality of pinion gears to correspond to the plurality of the nozzle shield plates 210. Thus, as the plurality of nozzle shield plates 210 are operated by the one rotary driving motor 250, a cooling fluid spraying width may be smoothly and easily varied in each of the stacked nozzle chambers 120.

As illustrated in FIGS. 3, 6, and 7, the plated steel sheet cooling apparatus according to an exemplary embodiment in the present disclosure may further include a spraying distance adjusting unit provided in the spraying unit to adjust a distance between the steel sheet 1 and the spraying unit.

The spraying distance adjusting unit may include a fixed frame, and a forward and backward driving motor 310 whose position is fixed, relative to the fixed frame and fastened to the spraying unit.

In this case, the fixed frame may be a structure whose position is fixed around the spraying unit, but is not limited to the plated steel sheet cooling apparatus according to an exemplary embodiment in the present disclosure.

As the motor shaft 311 is screw-fastened to a shaft connecting unit 111 formed on the main chamber 110 of the spraying unit, when the motor shaft 311 is rotated, the forward and backward driving motor 310 serves to move the spraying unit far from and near to the steel sheet 1.

In addition, to guide movement of the spraying unit, the spraying distance adjusting unit may further include a slider 320 fixed to and mounted on the spraying unit, and the guide rail 330 fastened to the slider 320 to allow the slider 320 to be slide-moved. In this case, the guide rail 330 may have a structure whose position is fixed, relative to the fixed frame.

Such a spraying distance adjusting unit adjusts a distance between the steel sheet 1 and the spraying unit in consideration of a defect generation distance of a plating layer according to a solidified state of the plating layer, thereby increasing a cooling performance.

The spraying width varying unit and the spraying distance adjusting unit configured as described above may be automatically controlled by a width sensor 350, a distance sensor 340, and a control unit C, as illustrated in FIG. 9.

FIG. 9 is a view illustrating that a width sensor and a distance sensor detect a width and a distance of a steel sheet, respectively, in the plated steel sheet cooling apparatus of FIG. 3.

With reference to FIG. 9, the plated steel sheet cooling apparatus according to an exemplary embodiment in the present disclosure may further include the width sensor 350 installed in the spraying unit to measure a width of the steel sheet 1, the distance sensor 340 installed in the spraying unit to measure a distance from the steel sheet 1, and the control unit C electrically linked to each of the width sensor 350 and the distance sensor 340.

Here, the width sensor 350 may be provided, by way of example, as a laser displacement sensor. Such a laser displacement sensor may include a light emitting unit in the form of a folding fan, irradiating a laser onto the steel sheet 1 and a light receiving unit receiving laser light reflected from the steel sheet 1. In addition, the distance sensor 340 may be provided as a laser sensor.

The control unit C may be electrically linked to the width sensor 350, and electrically linked to the rotary driving motor 250 of the plate driving unit providing moving force to the nozzle shield plates 210, thereby achieving an automatic control method of moving the nozzle shield plates 210 to correspond a width of the detected steel sheet 1 to a spraying width of the cooling fluid.

In addition, the control unit C may be electrically linked to the distance sensor 340, and electrically linked to the forward and backward driving motor 310 providing a moving force of the spraying unit, thereby achieving an automatic control method of moving the spraying unit far from and near to the steel sheet 1 to be matched with a distance of the steel sheet 1 to be set.

As illustrated in FIG. 10, the spraying unit may be disposed to have a multilayer structure in a direction of driving of the steel sheet 1, and may have a structure disposed to be close to the steel sheet 1 by the spraying distance adjusting unit as a plating solution in the steel sheet 1 is solidified.

As an example, when the spraying units are disposed to have a three layered structure in a direction of driving of the steel sheet 1, in a first layer as a position relatively close to a plating bath (not shown), in which a plating layer of the steel sheet 1 is in an unsolidified state till now, a distance from the steel sheet 1 is to be relatively large so as not to allow a defect such as a surface pattern generation, or the like to occur in the plating layer by a cooling fluid sprayed at high pressure.

Next, in second and third layers gradually spaced apart from the plating bath, as the plating layer of the steel sheet 1 is gradually solidified, a distance between the spraying unit and the steel sheet 1 becomes gradually smaller, thereby significantly increasing a cooling effect of the steel sheet 1.

Here, a spraying width and a spraying distance, and a cooling performance according to operating conditions of the plated steel sheet cooling apparatus, will be described with reference to FIG. 11.

First, in a table of FIG. 11A, material conditions of a steel sheet and operating conditions, a spraying width and a spraying distance of the plated steel sheet cooling apparatus are described. In this case, the operating conditions, a spraying width and a spraying distance, may be classified as fixed conditions in which a spraying width and a spraying distance are fixed, in the same manner as a related method (a related art process), and varied conditions, in which a spraying width and a spraying distance are varied according to an exemplary embodiment in the present disclosure.

In addition, the varied conditions are classified into cases (P1-P3 ) of varying a spraying width while a spraying distance is fixed, and cases (P4 to P7) of varying a spraying distance while a spraying width is fixed.

As a result of testing a cooling performance based on operating conditions, a spraying width and a spraying distance of the apparatus for cooling a plated steel sheet described above, cooling performances are increased by a cooling method according to an exemplary embodiment in the present disclosure in comparison with a cooling performance according to the related art, as illustrated in FIG. 11B.

In other words, when the spraying width is varied while the spraying distance is fixed (P1 to P3), cooling rates of P1 to P3 are higher than a cooling rate according to the related art. In addition, as a spraying width of a cooling fluid is similar to a width of a steel sheet (P3->P1), the cooling rates of P3 to P1 are increased. A cooling performance may be confirmed to be increased as a spraying width of a cooling fluid is varied by a spraying width varying unit according to an exemplary embodiment in the present disclosure to correspond to a width of a steel sheet.

When the spraying distance is varied while the spraying width is fixed (P4 to P7), cooling rates of P4 to P7 are increased in comparison with a cooling rate according to the related art. In addition, as a spraying width of a cooling fluid to a steel sheet is smaller (P7->P4), cooling rates from P7 to P4 are increased. The cooling performance may tend to be affected by the spraying distance of the cooling fluid to the steel sheet. In consideration of a defect generation distance of a plating layer according to a solidified state of the plating layer, as the spraying distance adjusting unit according to an exemplary embodiment in the present disclosure allows the spraying unit to be a closest to the steel sheet, a cooling performance may be increased.

As a result, the spraying width varying unit according to an exemplary embodiment in the present disclosure allows a spraying width of a cooling fluid to be varied to correspond to a width of a steel sheet, and thus a cooling performance may be increased and vibrations of a steel sheet may be decreased. Furthermore, the spraying width varying unit is installed outside of the spraying unit so as not to interfere with a cooling fluid flow path inside of the spraying unit to prevent collisions of the of cooling fluid flows inside of the spraying unit. Thus, fluid flow resistance is significantly reduced and a spraying pressure of the cooling fluid is prevented from being reduced, thereby further increasing a cooling performance.

In addition, the spraying distance adjusting unit, according to an exemplary embodiment in the present disclosure, adjusts a distance between the steel sheet and the spraying unit in consideration of a defect generation distance of a plating layer according to a solidified state of the plating layer, thereby increasing a cooling performance without a defect of the plating layer.

Meanwhile, the spraying nozzle according to an exemplary embodiment in the present disclosure configured as described above, to increase a cooling efficiency of a steel sheet and to reduce vibrations, a spraying angle of a cooling fluid, a spraying amount thereof, and an arrangement structure may have a following structure.

FIGS. 12A and 12B are views illustrating exemplary embodiments in the present disclosure with respect to an arrangement structure of the spraying nozzle formed in the nozzle spraying plate in the plated steel sheet cooling apparatus of FIG. 3. FIG. 13B is a view illustrating a path in which a cooling fluid is sprayed through an inclined spraying nozzle in the plated steel sheet cooling apparatus of FIG. 3.

With reference to FIGS. 12A, 12B, and 13B, the spraying nozzle is formed to allow a sprayed cooling fluid to be inclined according to a width of the steel sheet.

In detail, the spraying nozzle may be formed to be inclined toward an edge portion of the steel sheet to reduce a congestion amount of a cooling fluid colliding with the steel sheet.

In other words, as a spraying nozzle 131 is formed in the nozzle spraying plate 130 to be inclined toward an edge portion of the steel sheet with respect to an opposing steel sheet, a cooling fluid sprayed and colliding with the steel sheet may not be moved inversely again to reduce an amount of a cooling fluid to be congested.

In other words, as a cooling fluid sprayed through the spraying nozzle 131 collides with the steel sheet at an incline, the cooling fluid is reflected by the incline in a direction opposite to the steel sheet and moved. Thus, the cooling fluid is not congested between the nozzle spraying plate 130 and the steel sheet and flows smoothly and outwardly.

Furthermore, the spraying nozzle 131 may be formed at a greater incline with respect to a vertical axis of symmetry of the steel sheet as getting closer to the edge portion of the steel sheet.

In detail, as a central portion of the steel sheet is required to be cooled by a sprayed cooling fluid, a spraying direction of the spraying nozzle 131 may be a direction perpendicular to the steel sheet. In addition, the spraying direction of the cooling liquid may be from the direction perpendicular to the steel sheet to a gradually inclined direction as gradually getting from a center of the steel sheet to an edge portion thereof.

Here, an incline increase amount of the spraying nozzle 131 may be preferably increased gradually within a range of about 1°-3° from a center of the steel sheet. In a case in which the incline increase amount of the spraying nozzle is greater than the range of about 1°-3°, a considerable amount of a cooling fluid may be out of a steel sheet which is a spraying target. In a case in which the incline increase amount of the spraying nozzle is smaller than the range of about 1°-3°, cooling efficiency has almost no difference from a case of a cooling facility according to the related art spraying a cooling fluid in a vertical direction.

In addition, the spraying nozzle 131 may be formed to be inclined toward both edge portions based on a virtual center line of a width of the steel sheet as an axis of symmetry. More preferably, the spraying nozzle 131 may be formed to allow both sides thereof to be symmetrical with each other based on a virtual center line of a width of the steel sheet as an axis of symmetry.

In other words, the plurality of spraying nozzles 131 may have a form in which both sides are symmetrical with respect to each other, based on a virtual center line of a width of the steel sheet as an axis of symmetry. In detail, the spraying nozzles 131 formed in one side based on a center of a steel sheet, may be formed to be inclined to one edge portion of the steel sheet, and the spraying nozzles 131 formed in the other side may be formed to be inclined to the other edge portion thereof.

By the spraying nozzle 131 configured as described above, a cooling fluid sprayed onto a steel sheet is smoothly discharged outwardly, thereby increasing a cooling efficiency with respect to the steel sheet. In other words, in a plated steel sheet cooling apparatus according to the related art, a slot type spraying nozzle 32*a* formed in a nozzle chamber 32 has a structure in a non-inclined form as illustrated in FIG. 13A, and thus, cooling fluids sprayed to be perpendicular to a steel sheet collide with each other between nozzles disposed to be multilayer and temporary congestion occurs. Thus, an ambient temperature may be increased and a cooling performance may be decreased by heat transfer resistance due to high temperature congested air, which may be prevented by an exemplary embodiment in the present disclosure configured as described above.

Furthermore, collisions of the cooling fluids may cause a strong collision vortex, and such a strong collision vortex may be a cause of increasing vibrations of a steel sheet. As a cooling fluid is smoothly discharged outwardly in a lateral direction even in an edge portion of the steel sheet due to the inclined spraying nozzle 131 according to an exemplary embodiment in the present disclosure, such vibrations of the steel sheet may be reduced.

In addition, the spraying nozzle 131 may be formed to allow a horizontal level to be higher toward an edge portion 130*b* based on a horizontal position in a central portion 130*a* of the nozzle spraying plate 130.

Furthermore, such a spraying nozzle 131 may preferably be formed to allow a horizontal level to be higher toward both edge portions 130*b* based on a virtual center line of a width of the steel sheet as an axis of symmetry.

Here, an increase amount of the horizontal level of the spraying nozzle 131 may be an appropriate increase amount so as not to allow the spraying nozzle 131 in one column to interfere with the spraying nozzle in other columns adjacent to one column. As an example, when an interval between other columns adjacent to each other is relatively small, an increase amount of the horizontal level of the spraying nozzle may be relatively small. On the other hand, when an interval between other columns adjacent to each other is great, an increase amount of the horizontal level of the spraying nozzle may be great. It is because a vortex may be formed as cooling fluids sprayed onto the steel sheet collide with each other in an interfered portion. As illustrated in FIG. 12B, a horizontal level of the spraying nozzle may be increased by a maximum height (h) so as not to interfere with spraying nozzles in other columns.

More preferably, the spraying nozzle 131 may be formed to allow horizontal levels of both sides to be symmetrical with each other based on a virtual center line of a width of the steel sheet as an axis of symmetry.

As cooling fluids sprayed from both ends of each of the spraying nozzles 131 adjacent in a lateral direction are overlapped with each other, a vortex occurs. As described above, a horizontal level of the spraying nozzles 131 becomes higher toward the edge portion 130*b*, thereby reducing a vortex occurring by overlapping of the cooling fluids.

A cooling effect may be increased by reducing that flowing of a cooling fluid sprayed onto a steel sheet is interrupted by the vortex occurring.

Meanwhile, the spraying nozzle 131 may be formed to allow a spraying amount of a cooling fluid to be varied according to a width of the steel sheet.

In detail, a plurality of the spraying nozzles 131 may be formed to have a larger size toward a central portion 130*a* of the nozzle spraying plate 130, to allow a spraying amount of the spraying nozzle to be increased toward a center of the steel sheet. In other words, the plurality of the spraying nozzles 131 may be formed to have a smaller size toward an edge portion 130*b* of the nozzle spraying plate 130.

As an example, the spraying nozzle 131 as illustrated in FIGS. 12A and 12B, is preferably formed to have a vertical height relatively larger toward the central portion 130*a* from the edge portion 130*b* of the nozzle spraying plate 130.

By the spraying nozzle 131 configured as described above, an amount of a cooling fluid to be sprayed is increased toward a center of the steel sheet, thereby increasing a cooling effect with respect to the center of the steel sheet in which a temperature is relatively high.

In other words, as the edge portion of the steel sheet is close to an outside and the center of the steel sheet is away from the outside, the edge portion may be cooled relatively better than the center due to external air and a cooling efficiency of the center may be decreased, which may be prevented according to an exemplary embodiment in the present disclosure configured as described above.

In addition, a relatively small amount of a cooling fluid is sprayed onto the edge portions of the steel sheet in comparison with the center thereof, thereby reducing vibrations in the steel sheet occurring by a collision vortex in the edge portion occurring as the cooling fluid passes through a front and a rear while surrounding the edge portions.

In addition, in an apparatus installed in a place in which a steel sheet is driving upwardly of plated steel sheet cooling apparatuses, a plating layer of a steel sheet passing through an inside thereof is in an unsolidified state in which the plating layer is not yet solidified. In a case of using not a slot type nozzle but a round type nozzle, as a steel sheet is unevenly cooled in a width direction, a striped surface defect may occur.

In other words, in a case of the slot type nozzle in which spraying nozzles are connected to each other in a width direction of a nozzle spraying plate, as a cooling fluid is entirely sprayed in a width direction of the steel sheet, cooling is uniformly performed in the width direction of the steel sheet. In a case of the spraying nozzle 131 according to an exemplary embodiment in the present disclosure, disposed to be a plurality of the spraying nozzles in a width direction of the nozzle spraying plate 130, as a cooling fluid is non-uniformly sprayed thereonto, a vertical stripe may be formed on the steel sheet, and thus, a quality of the steel sheet may be decreased.

To prevent this, the spraying nozzle 131 according to an exemplary embodiment in the present disclosure may be configured to uniformly cool the steel sheet in a width direction of the steel sheet. The spraying nozzles may be disposed in multi-columns in the nozzle spraying plate 130 in a direction of driving of the steel sheet and the spraying nozzles 131 in columns different from each other may be disposed alternately.

The spraying nozzles 131 are disposed as described above to have an arrangement structure in which upper spraying nozzles 131 and lower spraying nozzles 131 are alternately disposed. Thus, a cooling fluid is uniformly sprayed onto a steel sheet driven upwardly, thereby uniformly cooling the steel sheet in the width direction.

As a result, with respect to the spraying nozzle 131 according to an exemplary embodiment in the present disclosure, as the spraying nozzle 131 is formed to be inclined toward an edge portion of the steel sheet, a cooling fluid sprayed onto the steel sheet is smoothly discharged outwardly, thereby increasing a cooling efficiency with respect to the steel sheet.

In addition, as a horizontal level of the spraying nozzle 131 becomes higher toward the edge portion 130*b* of the nozzle spraying plate 130 based on a horizontal position in the central portion 130*a* thereof, overlapping of cooling fluids sprayed from the spraying nozzles adjacent in a lateral direction, respectively is decreased, thereby increasing a cooling effect.

In addition, as the spraying nozzle 131 is formed to have a relatively larger size toward the central portion, an amount of a cooling fluid to be sprayed is increased toward the center of the steel sheet. Thus, a cooling effect with respect to the center of the steel sheet in which a temperature is relatively high, may be increased.

In addition, the spraying nozzles 131 are disposed in multi-columns, and the spraying nozzles 131 in columns different from each other are disposed alternatively. Thus, as cooling fluids are uniformly sprayed entirely in a width direction of the steel sheet, cooling is uniformly performed in the width direction.

While exemplary embodiments have been shown and described above, it will be apparent to those skilled in the art that modifications and variations could be made without departing from the scope of the present disclosure as defined by the appended claims.

The invention claimed is:

1. A plated steel sheet cooling apparatus comprising:

a spraying unit opposing a driving steel sheet and spraying a cooling fluid;

a plurality of nozzle shield plates disposed in a front side of the spraying unit, and varying a spraying width of the cooling fluid while moving far from or near to each other on both sides;

a plate driving unit moving the plurality of nozzle shield plates;

a width sensor disposed in the spraying unit to measure a width of the driving steel sheet; and a control unit electrically linked to the width sensor and the plate driving unit, and controlling movement of the plurality of nozzle shield plates according to the width of the driving steel sheet.

2. The plated steel sheet cooling apparatus of claim 1, further comprising:

a spraying distance adjusting unit disposed in the spraying unit to adjust a distance between the driving steel sheet and the spraying unit.

3. The plated steel sheet cooling apparatus of claim 1, wherein each of the plurality of nozzle shield plates has a rack gear, and wherein the plate driving unit includes:

a plurality of rotary shafts each of which having a plurality of pinion gears respectively engaged with the rack gear; and a rotary driving member rotating the plurality of rotary shafts.

4. The plated steel sheet cooling apparatus of claim 3, wherein when two of the plurality of rotary shafts connected to two of the plurality of nozzle shield plates, respectively, are disposed on both sides of the spraying unit, respectively, the rotary driving member includes:

lateral gearboxes mounted on upper ends of the two rotary shafts and disposed to be two lateral gearboxes thereon;

a rotary driving motor installed on the spraying unit;

a central gearbox to which a motor shaft of the rotary driving motor is connected; and two connection bars in which one end is connected to the lateral gearbox and another end is connected to the central gearbox.

5. The plated steel sheet cooling apparatus of claim 3, wherein when a nozzle chamber having spraying nozzles is stacked to be a plurality of nozzle chambers in the spraying unit, the plurality of nozzle shield plates are disposed to correspond to the plurality of nozzle chambers.

6. The plated steel sheet cooling apparatus of claim 1, further comprising:

plate guides holding and supporting the plurality of nozzle shield plates and slide-guiding the plurality of nozzle shield plates when the plurality of nozzle shield plates move, in respective upper and lower portions of the front side of the spraying unit.

7. The plated steel sheet cooling apparatus of claim 2, wherein the spraying distance adjusting unit includes:

a fixed frame; and a forward and backward driving motor whose position is fixed, relative to the fixed frame, and including a motor shaft screw-fastened to the spraying unit to move the spraying unit far from or near to the driving steel sheet in rotation.

8. The plated steel sheet cooling apparatus of claim 7, wherein the spraying distance adjusting unit further includes:

a slider fixed to and mounted on the spraying unit; and a guide rail whose position is fixed, relative to the fixed frame and to which the slider is fastened to be slide-moved.

9. The plated steel sheet cooling apparatus of claim 7, wherein the spraying distance adjusting unit further includes:

a distance sensor installed in the spraying unit to measure a distance from the driving steel sheet, wherein the control unit is electrically linked to the distance sensor and the forward and backward driving motor, and controls movement of the spraying unit to correspond to a distance from the driving steel sheet which is to be set.

10. The plated steel sheet cooling apparatus of claim 7, wherein the spraying unit has a multilayer structure in a direction of driving of the driving steel sheet, and the spraying unit is disposed to be close to the driving steel sheet by the spraying distance adjusting unit when a plating solution in the driving steel sheet is solidified.

* * * * *